United States Patent [19]

Cerini et al.

[11] Patent Number: 4,665,870

[45] Date of Patent: May 19, 1987

[54] I.C. DIESEL ENGINE WITH LOW PERMANENT MAGNETIC SIGNATURE

[75] Inventors: Adolfo G. Cerini; Gianpiero R. Riganti, both of Milan, Italy

[73] Assignee: Isotta Fraschini S.p.A., Varese, Italy

[21] Appl. No.: 834,572

[22] Filed: Feb. 28, 1986

[30] Foreign Application Priority Data

Apr. 4, 1985 [IT] Italy ..... 20233 A/85

[51] Int. Cl.[4] ..... F02F 7/00

[52] U.S. Cl. ..... 123/195 R; 440/3; 114/15

[58] Field of Search ..... 123/195 R; 440/3, 113; 114/15

[56] References Cited

U.S. PATENT DOCUMENTS 3,400,695 9/1968 Zakuba ..... 123/195 R 3,528,397 9/1970 Seifert ..... 123/195 R

*Primary Examiner*—Ronald B. Cox

*Attorney, Agent, or Firm*—Stevens, Davis, Miller & Mosher

[57] ABSTRACT

The invention relates to a Diesel engine in which there is obtained a very low permanent magnetic signature by embodying some of its component parts with high volume/mass ratio in a magnetic material, and by reducing or annulling the permanent magnetism of its component parts which are for constructional reasons made of magnetic material by individual demagnetization treatment.

6 Claims, No Drawings

I.C. DIESEL ENGINE WITH LOW PERMANENT MAGNETIC SIGNATURE

It is known that there is a need for engines with low permanent magnetic signature, i.e. which cannot be detected by instruments sensitive to a magnetic field disturbing the earth's magnetic field.

There is a particular demand for engines of such kind for military naval craft. The most evident solution to the problem of embodying engines possessing the characteristic in question is to make large scale use therein of components made of amagnetic material. However, the feasibility of adopting such a solution is gainsaid by the manifold constructional difficulties it meets with, in that the mechanical and thermal stress that the parts in an internal combustion engine are subject to calls for the use of very high-cost special materials in order that the desired amagnetic and mechanical characteristics may be obtained conjointly.

For example, a plentiful use of materials such as titanium is required.

The compensation by means of permanent magnets of the magnetic fields due to the magnetism of the single parts of the engine is moreover complex to effect, not stable over time and not fully satisfactory as far as residual signature is concerned. Satisfactory results cannot be achieved even with a demagnetization of the assembled engine, in which different various parts react variously to the treatment depending on their orientation and mass.

The objection of the present invention is to embody an internal combustion engine in which the low permanent magnetic signature is obtained by appropriate selective treatment of its different component parts, whereby to make the overall magnetic characteristic of said engine satisfactory.

According to the present invention a I.C. Diesel engine with low permanent magnetic signature is embodied, in which the parts with relatively high mass and a high volume/mass ratio are made of amagnetic material, and the parts made of magnetic material are caused to have, by individual magnetic treatment, a permanent residual magnetism substantially equal as far as its fixed vertical component is concerned to the magnetism which the part possesses as a result of the earth's magnetic field at a given latitude, and a substantially nil permanent magnetism as far as the horizontal component is concerned.

In order better to clarify the objects of the invention and how they can be attained in practice in the embodiment of internal combustion engines, a more detailed description of the methods for embodying a low permanent magnetic signature engine is now given. Conceptually, the engine must be broken down into its component parts, which are assigned to two principal classes:

(a) parts which have to be formed out of amagnetic material in order to obtain the desired magnetic signature values;

(b) parts which have necessarily to be made out of magnetic material if they are to posses the mechanical properties required for the engine to function.

The parts falling within class (a), i.e. those made out of amagnetic material, should in general be all parts with a high volume/mass ratio, typically the crankcase, the cylinder liners, the cylinder heads and the flywheel. All the component parts for which the adoption of amagnetic material does not involve important technical problems due to low criticality of embodiment are also made of amagnetic material.

The parts falling within class (b) above typically comprise the crankshaft, the connecting rods, the camshaft and other timing system organs.

According to the present invention, such magnetic components are given a demagnetization treatment which takes account of the configurational and functional characteristics of each component, as also of its position in the engine, and which also takes into account the geographical area considered average for the engine to operate in.

The said demagnetization treatment, known as "deperming" and not per se forming object of the present invention, is adopted for demagnetizing the component parts of the engine using different methods depending both on the extent of the magnetic signature of the component part and on the position of the part in the engine. It in fact proves advantageous from the standpoint of treatment costs and times to divide the engine parts to be demagnetized into duscrete classes according to their dimension, given that parts with a high mass require a correspondingly long demagnetization treatment time.

There are, on the other hand, parts of the engine which are less magnetically significant, and these may only require a magnetic control to detect any accidental high magnetizations of an abnormal kind.

The methods of demagnetization depend on the configurational and positional characteristics of the ferromagnetic components of the engine, as has been stated, and such components can basically be divided into three groups on the basis of said characteristics, as follows:

Group I: component parts which, in their position in the engine, have a low demagnetization factor along the vertical axis, of which connecting rods are a typical example;

Group II: component parts which, in their position in the engine, have a low demagnetization factor along the horizontal axis, as for example camshafts;

Group III: component parts which, in their position in the engine, have a low demagnetization factor both along the vertical axis and along the horizontal axis and which rotate during the running of the engine.

In the deperming process the components of Group I are brought to a state of permanent magnetization equal to that which they would reach spontaneously if maintained for an indefinite lenght of time in the geomagnetic field of a given region. The treatment of the component parts belonging to this Group does not take into account the magnetization along the horizontal axis which can be considered negligible for the configurational characteristics involved.

In the "deperming" process, the second group of components parts is so treated as practically to eliminate all permanent magnetization along the horizontal axis. Given their configuration, they are in practice insensitive to variations in the vertical component of external fields.

As the orientation of a ship varies as its course is changed and in view of the time taken by alloy steels to modify their permanent magnetization equilibrium in the presence of the earth's magnetic field, it can be assumed that the magnetization value of the component parts belonging to this group will remain practically negligible during the life of the engine. Certain opportune measures will have to be adopted only during the period of storage of said component parts, for example by orientating them east/west.

The "deperming" of the component parts of the third group should also leave them substantially without any permanent magnetization.

As mentioned previously, the results of the magnetization procedures leading to the described magnetic level of the different component parts of the engine must not be in any way altered by storing the engine or its components in the vicinity of large ferromagnetic masses or permanent magnetic fields, and parts must of course be placed at a suitable recpirocal distance.

Lastly, the major axis of the engine and parts of elongated configuration should be maintained in an east/west direction.

It is of importance to note that the engine the components parts of which have the above mentioned magnetic characteristics does not itself require, on completion, to be given a demagnetization or "deperming" treatment—which would in fact be detrimental in that the principle informing the present invention provides for a specific treatment for each single part in order to obtain the low signature of the engine as an overall result. For, in view of the different reactions to the "deperming" treatment of each of the components parts, as a function of their mass and their position in the engine, the "deperming" treatment of the assembled engine, whatever demagnetization treatment is used, does not give a satisfactory result.

Furthermore, the possibility of treating the component parts singly or by homogeneous groups allows the use of demagnetization facilities which are not overburdensome given the powers required, and which keep demagnetization times within acceptable limits.

The uniformity of the magnetic characteristics of the components parts classified by groups as indicated heretofore enables them to be given "overall" demagnetization or "deperming" treatment which are in consequence exactly time. This brings great advantages in term of the length of the treatment times giving the best results.

We claim:

1. A I.C. Diesel engine with low permanent magnetic signature in which the parts with a relatively high mass and a high volume/mass ratio are made of amagnetic material and the parts made of magnetic material are caused to have, by individual magnetic treatment, a residual permanent magnetism substantially equal in its fixed vertical component to the magnetism which the part possesses as a result of the earth's magnetic field at a given latitude, and a substantially zero permanent magnetism in its horizontal component.

2. An internal combustion engine according to claim 1, characterized in that the rotating parts of the engine without fixed vertical axis are demagnetized until there is in them a substantially zero permanent magnetization.

3. An I.C. engine according to claim 1, characterized in that the longitudinal component parts with low demagnetization factor along a horizontal axis when the parts are mounted in the engine are demagnetized so that they are left with a substantially zero permanent magnetization.

4. A method of composing an I.C. engine according to claim 1, characterized in that the component parts made of magnetic material are subdivided into discrete groups according to their mass, their configuration and their position in the engine, and are given a demagnetization treatment to bring their permanent magnetization to a pre-set value as regards degree and position.

5. A method according to claim 4, characterized in that the pieces having vertical longitudinal development intended to be mounted in a fixed state in the engine are demagnetized to the extent of maintaining in them a permanent magnetismmm value along the vertical axis equal to the value of the geomagnetic field of a pre-determined area of the earth.

6. A method according to claim 4, characterized in that the component parts having a horizontal longitudinal development and the parts intended to rotate when the engine is running are demagnetized until they are left with a substantially zero permanent magnetism value.

* * * * *